US007109965B1

(12) United States Patent
Lee et al.

(10) Patent No.: US 7,109,965 B1
(45) Date of Patent: Sep. 19, 2006

(54) APPARATUS AND METHOD FOR ELIMINATING RESIDUAL IMAGE IN A LIQUID CRYSTAL DISPLAY DEVICE

(75) Inventors: Hyun Chang Lee, Kumi-shi (KR); Won Gyun Youn, Daegukwangyeok-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

(21) Appl. No.: 09/353,847

(22) Filed: Jul. 15, 1999

(30) Foreign Application Priority Data

Sep. 15, 1998 (KR) ..... 1998-38119

(51) Int. Cl.
*G09G 3/36* (2006.01)

(52) U.S. Cl. ..... 345/98; 345/92

(58) Field of Classification Search ..... 345/98, 345/99, 100, 91, 92, 90, 76, 79, 89, 95, 87; 363/97

See application file for complete search history.

(56) References Cited

U.S. PATENT DOCUMENTS

| | | | | |
|---|---|---|---|---|
| 4,975,691 | A * | 12/1990 | Lee | 345/79 |
| 5,155,613 | A | 10/1992 | Sakayori | 359/85 |
| 5,248,963 | A * | 9/1993 | Yasui et al. | 345/98 |
| 5,414,443 | A * | 5/1995 | Kanatani et al. | 345/95 |
| 5,680,064 | A * | 10/1997 | Masaki et al. | 326/81 |
| 5,754,155 | A * | 5/1998 | Kubota et al. | 345/98 |
| 5,793,346 | A * | 8/1998 | Moon | 345/92 |
| 5,818,406 | A * | 10/1998 | Tsuchi et al. | 345/89 |
| 5,990,857 | A * | 11/1999 | Kubota et al. | 345/98 |
| 6,064,360 | A | 5/2000 | Sakaedani et al. | 345/92 |
| 6,097,616 | A * | 8/2000 | Iwasaki | 363/97 |
| 6,271,812 | B1 * | 8/2001 | Osada et al. | 345/76 |
| 6,580,411 | B1 * | 6/2003 | Kubota et al. | 345/98 |

FOREIGN PATENT DOCUMENTS

| | | |
|---|---|---|
| EP | 364 590 | 4/1990 |
| EP | 529 701 A2 | 3/1993 |
| EP | 0 764 932 A2 | 3/1997 |
| EP | 764 932 A2 | 3/1997 |
| EP | 0 881 622 A1 | 12/1998 |
| EP | 881 622 A1 | 12/1998 |
| JP | 10-161080 | 6/1998 |
| JP | 10-214067 | 8/1998 |

OTHER PUBLICATIONS

"Black/White Drive Method for Thin Film Transistor-Liquid Crystal Display at Power-Off." *IBM Technical Disclosure Bulletin*. vol. 39, No. 11, Nov. 1996.

* cited by examiner

*Primary Examiner*—Jimmy H. Nguyen
(74) *Attorney, Agent, or Firm*—McKenna Long & Aldridge LLP

(57) ABSTRACT

A residual image eliminating apparatus and method for a liquid crystal display device is adaptive for eliminating residual images emerging on a screen after power-off due to electric charges accumulated in pixel cells. In the apparatus, upon power-on, a first voltage level for turning off thin film transistors is applied to gate lines. Upon power-off, a higher level voltage than a ground voltage is applied to the gate lines. At this time, a voltage at the gate line is raised into a voltage level capable of opening a channel of the thin film transistor, thereby discharging an electric charge charged in a pixel. As a result, residual images are rapidly eliminated from the liquid crystal panel upon power-off.

25 Claims, 7 Drawing Sheets

APPARATUS AND METHOD FOR ELIMINATING RESIDUAL IMAGE IN A LIQUID CRYSTAL DISPLAY DEVICE

This application claims the benefit of Korean Patent Application No. P98-38119, filed on Sep. 15, 1998, which is hereby incorporated by reference.

BACKGROUND OF THE INVENTION

1. Field of the Art

This invention relates to a liquid crystal display device displaying an image employing a light transmissivity of liquid crystal, and more particularly to a residual image eliminating apparatus and method that is adaptive for eliminating a residual image emerging on a screen due to a residual electric charge accumulated in a picture element (or pixel) cell after a power source was turned off.

2. Description of the Related Art

Recently, there has been an accelerated development of a flat panel display device of an active matrix driving system, for example, a liquid crystal display device using thin film transistors (TFTs) as switching devices. Since such a liquid crystal display apparatus can have a smaller dimension in comparison to the existing cathode ray tube (or brown tube), it has been commercially available for a display device of a portable television, a lap-top personal computer, and so on.

Referring to FIG. 1, there is shown a pixel cell of a liquid crystal display panel that includes a TFT 10 having a gate connected to a gate line 11 and a source connected to a data line 13, and a parallel connection of a liquid crystal cell 12 and a support capacitor 14 between a drain of the TFT 10 and a common voltage source Vcom. The TFT 10 is turned on with a voltage higher than a threshold voltage applied to the gate thereof upon displaying of a picture, thereby connecting the data line 13 to the liquid crystal cell 12 and the support capacitor 14. The liquid crystal cell 12 and the support capacitor 14 accumulate a voltage of an image signal Vd from the data line 13 when the TFT 10 is turned on, and maintains the accumulated voltage until the TFT 10 is turned on again. Upon line inversion driving, the polarity of the common voltage Vcom is inverted depending on the gate line 11, thereby supplying the adjacent gate lines with a common voltage Vcom having the contrary polarity with respect to each other.

When a power source of the liquid crystal display panel is turned on, a gate low voltage Vg1 having a voltage level less than the gate threshold voltage Vth is supplied to gate lines 11, excluding the gate line coupled with the image signal Vd. This gate low voltage Vg1 is set to have a value lower than the minimum value of the image signal Vd. On the other hand, when a power source of the liquid crystal display panel is turned off, the gate low voltage Vg1, the image signal Vd and the common voltage Vcom are converged into a specific level (i.e., a voltage level corresponding to a ground voltage supplied during operation of the liquid crystal display panel, hereinafter referred to as "ground level" GND). At this time, the gate low voltage Vg1 changes as shown in FIG. 2. Typically, the liquid crystal display device includes a residual image eliminating apparatus for eliminating a residual image by converging the gate low voltage Vg1 to the ground level GND after a power source of the liquid crystal display panel was turned off.

As shown in FIG. 3, the residual image eliminating apparatus includes a zener diode ZD for maintaining the gate low voltage Vg1 to be supplied to the gate line 11 at a predetermined level, and a transistor Q1 for switching a current path for converging the gate low voltage Vg1 into the ground level GND when a power source of the liquid crystal display panel was turned off. Also, the residual image eliminating apparatus has a capacitor C1 connected between a positive voltage line PVL and the base of the transistor Q1. The zener diode ZD is commonly connected to the gate low voltage line VGLL and the emitter of the transistor Q1 to always lower a negative voltage $V_{EE}$ from a negative voltage line NVL into its breakdown voltage, and supplies the lowered voltage to the gate low voltage line VGLL. For example, if the negative voltage $V_{EE}$ is −5V and the breakdown voltage of the zener diode ZD is 1V, then the gate low voltage Vg1 becomes −6V. The transistor Q1 is a PNP-type transistor which receives a voltage $V_{DD}$ having a positive level (e.g., 5V or 3.3V) from the positive voltage line PVL at the base thereof through the capacitor C1 when a power source of the liquid crystal display panel is turned on. At this time, since almost an infinite value of resistance exists between the emitter and the collector of the transistor Q1, the gate low voltage Vg1 on the connection node between the zener diode ZD and the transistor Q1 is not bypassed into the ground voltage GND, but it is supplied to the gate low voltage line VGLL. Meanwhile, the capacitor C1 charges the positive voltage VDD from the positive voltage line PVL.

When a power source of the liquid crystal panel is turned off, the ground voltage GND is developed on each of the negative voltage line NVL and the positive voltage line PVL. At the same time, the capacitor C1 applies a negative polarity voltage—VDD to the base of the transistor Q1 by the charged electric charges thereof. Then, the transistor Q1 is turned on by converging the positive voltage $V_{DD}$ into the ground level GND, thereby connecting its emitter to the collector. The gate low voltage Vg1 is converged into the ground level GND by turning on the transistor Q1. The zener diode ZD is turned off by converging the negative voltage $V_{EE}$ [and the gate low voltage Vg1] into the ground level GND.

On the other hand, upon line inversion driving, the common voltage Vcom having an alternating current shape as shown in FIG. 4 is supplied to the liquid crystal cell 12 and the support capacitor 14. During line inversion driving, the gate low voltage Vg1 is supplied to the gate line 11 in a shape of alternating current synchronized with the common voltage Vcom by means of an alternating current source AC and a coupling capacitor Cc. When a power source of the liquid crystal display panel is turned off, the common voltage Vcom is converged into the ground level GND. At this time, A side pixels charged with a negative polarity level with respect to the ground level GND and B side pixels charged with a positive polarity level with respect to the ground level GND exist in the liquid crystal display panel. If a power source of the liquid crystal display panel is turned off, then a channel of the TFT is turned on because the image signal Vd, the gate low voltage Vg1 and the common voltage Vcom are charged into the ground level GND and a negative polarity voltage with respect to the ground level GND is charged in the A side pixel. Accordingly, the voltage charged in the A side pixel is converged into the ground level GND. In other words, when a negative(−) voltage is charged into the liquid crystal cell 12 based on the ground level GND, a voltage applied to the gate of the TFT 10 becomes higher than a pixel charge voltage Vp. As a result, electric charges charged in the liquid crystal cell 12 are bypassed into the data line 13, so that a residual image does not emerge at the corresponding lines.

Otherwise, since a channel of the TFT connected to the B side pixel charged with a positive(+) voltage with respect to the ground level GND is turned off, the pixel voltage Vp is converged into the ground level GND slowly. In other words, in the case of the liquid crystal cell 12 charged with a positive (+) voltage based on the ground level GND before the power source is turned off, a voltage applied to the gate of the TFT 10 becomes lower than the pixel charge voltage Vp. Accordingly, even though a power of the liquid crystal display panel is turned off, a residual image emerges on a screen (i.e., a liquid crystal display panel). Further, in the case of being driven in the line inversion system, a residual image appears at odd-numbered gate lines 11 or even-numbered gate lines 11. It takes a considerable time (i.e., more than about one minute) to extinguish such a residual image.

SUMMARY OF THE INVENTION

Accordingly, it is an object of the present invention to provide a residual image eliminating apparatus and method that is adaptive for eliminating a residual image emerging due to a residual electric charge existing in a pixel cell after the shut off of a power supply.

In order to achieve this and other objects of the invention, a residual image eliminating apparatus for a liquid crystal display device according to an aspect of the present invention includes a liquid crystal panel having a plurality of gate lines and a plurality of data lines crossing perpendicularly with respect to each other, and thin film transistors connected to the gate lines and the data lines to switch image signals to be applied to liquid crystal cells, and level shifting means for receiving a power supply voltage and a ground voltage to apply a first voltage level for turning off the thin film transistors to the gate lines upon power-on and to apply a higher voltage level than the ground voltage to the gate lines upon power-off.

A residual image eliminating method for a liquid crystal display device according to another aspect of the present invention includes the steps of receiving a power supply voltage and a ground voltage to apply a first voltage level for turning off the thin film transistors to the gate lines upon power-on, and applying a higher level voltage than the ground voltage to the gate lines upon power-off.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

Figure 1:
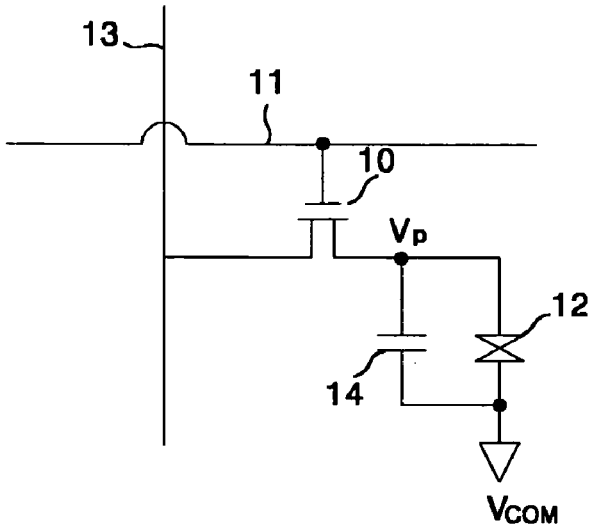
FIG.1 PRIOR ART
FIG. 1 is an equivalent circuit diagram of a pixel cell of a conventional liquid crystal display panel employing thin film transistors.
Figure 2:
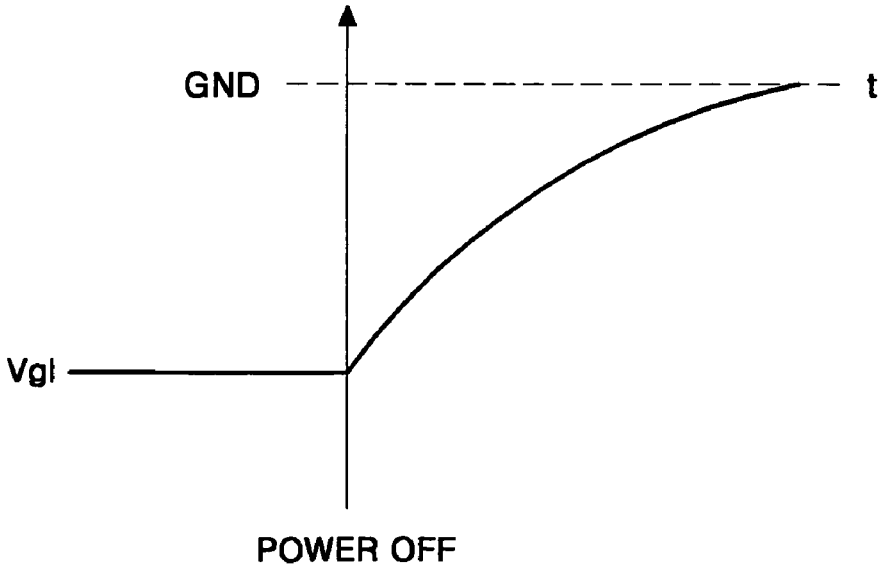
FIG.2 PRIOR ART
FIG. 2 is a waveform diagram showing a voltage change in a gate line when a power source of the liquid crystal display panel is turned off.
Figure 3:
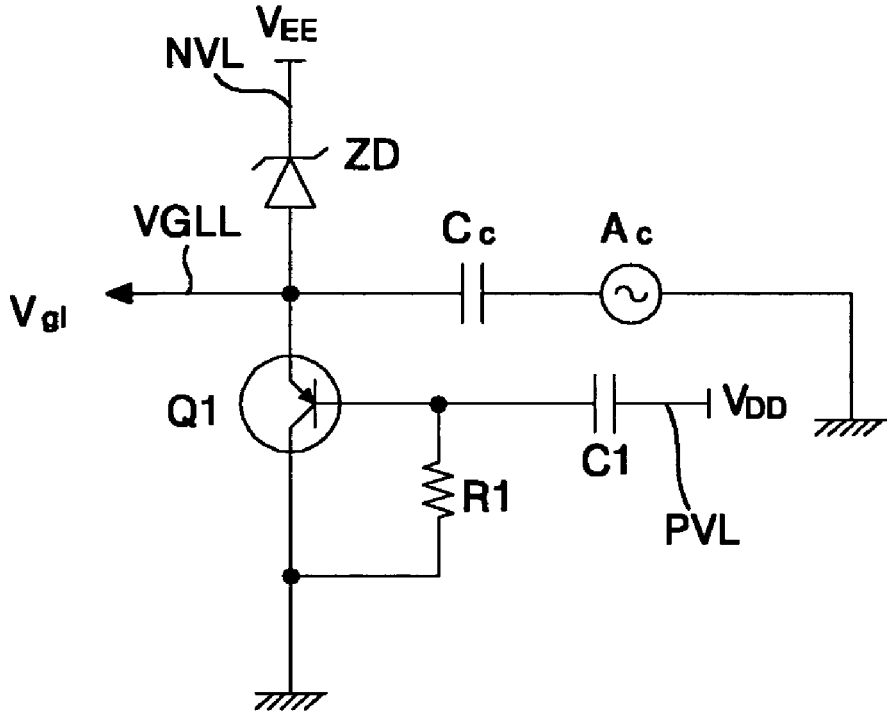
FIG.3 PRIOR ART
FIG. 3 is a schematic circuit diagram of a residual image eliminating apparatus of the conventional liquid crystal display device.
Figure 4:
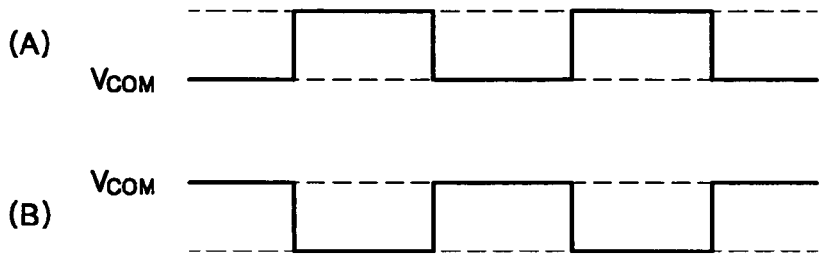
FIG.4 PRIOR ART
FIG. 4 is waveform diagrams depicting a variation in a common voltage supplied to the pixel cell shown in FIG. 1.
Figure 5:
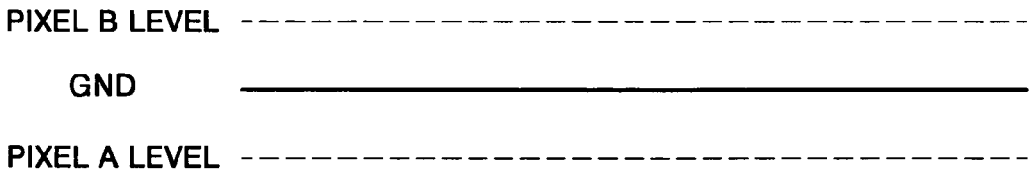
FIG.5 PRIOR ART
FIG. 5 illustrates charged voltages in the pixels during power-off.
Figure 6:
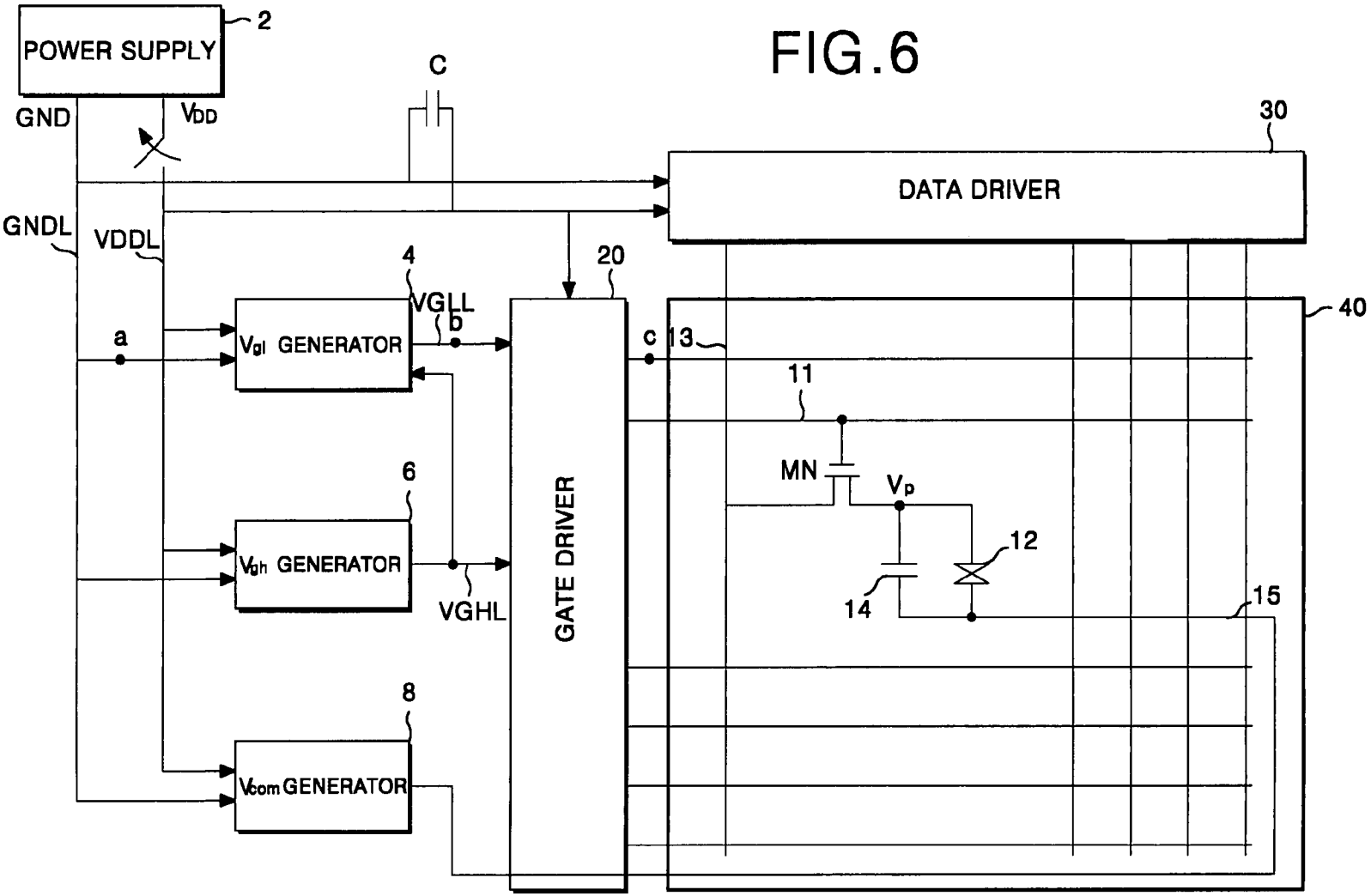
FIG. 6 is a schematic view of a liquid crystal display device employing a residual image eliminating apparatus according to an embodiment of the present invention.

Referring to FIG. 6, there is shown a liquid crystal display device according to an embodiment of the present invention. The liquid crystal display device includes m gate lines and n data lines intersecting with respect to each other, and a liquid crystal display panel 40 provided with a common voltage electrode 15. Each gate line 11 is connected to each gate terminal of TFTs MN and each data line 13 is connected to each source terminal of the TFTs MN. A liquid crystal cell 12 and a support capacitor 14 is connected, in parallel, between the drain terminal of the TFT MN and the common voltage electrode 15. The support capacitor 14 can be connected to an adjacent gate line 11 instead of to the common voltage electrode 15. The common voltage electrode 15 is formed in a plate shape on one glass substrate (not shown) opposed to another glass substrate (not shown) defined with the gate lines 11 and the source lines 13. Alternatively, the common voltage electrode 15 may be implemented with a number of common voltage lines formed in parallel to the gate lines 11 or the source lines 13 like the IPS (In Plain Switching mode) LCD.

The liquid crystal display device includes a gate driver 20 connected to the gate lines 11, a data driver connected to the data lines 13, a power supply 2 for supplying a ground voltage level GND and a supply voltage $V_{DD}$, a gate low voltage generator 4 and a gate high voltage generator 6 connected between the power supply 2 and the gate driver 20 to supply a different level of gate voltages Vg1 and Vgh to the gate driver 20, respectively. A common voltage generator 8 is connected between the power supply 2 and the common voltage electrode 15 to supply a common voltage Vcom to the common voltage electrode 15. The gate driver 20 sequentially applies a scanning pulse to the m gate lines 11, thereby sequentially driving pixels on the liquid crystal display panel 40 line by line.

The data driver 30 is synchronized with the scanning pulse to apply an image signal Vd corresponding to a logical value of red (R), green (G), and blue (B) video data to each of the n data lines 13. The gate low voltage generator 4 level-shifts the gate low voltage Vg1 to higher than the ground level GND upon shut-off of the supply voltage to form a channel in the TFT MN, thereby discharging electric charges charged in the liquid crystal cell 12 and the support capacitor 14 through the drain and the source of the TFT MN to the source lines 13. Herein, the gate low voltage Vg1 is a difference voltage between a voltage at a ground voltage input line GNDL of the gate low voltage generator 4 and a voltage at an output line VGLL of the gate low voltage generator 4 (or an optional point c at the gate line 11 which is an output line of the gate driver 20). This gate low voltage Vg1 is detected by contacting probes of a voltage meter (not shown) at each of the above two points (i.e., a and b, or a and c).

The gate high voltage generator 6 makes use of a supply voltage $V_{DD}$ applied from the power supply 2 through a supply voltage line VDDL to generate a gate high voltage Vgh having a voltage level higher than the maximum value of the data plus the threshold voltage of the TFT MN and supplies the gate high voltage Vgh to the gate driver 20 through a gate high voltage line VGHL. The common voltage generator 8 allows a contrary polarity of common voltage Vcom to be supplied to the liquid crystal cells 12 and the support capacitors 14 connected to even-numbered and odd-numbered gate lines 11.

Figure 7:
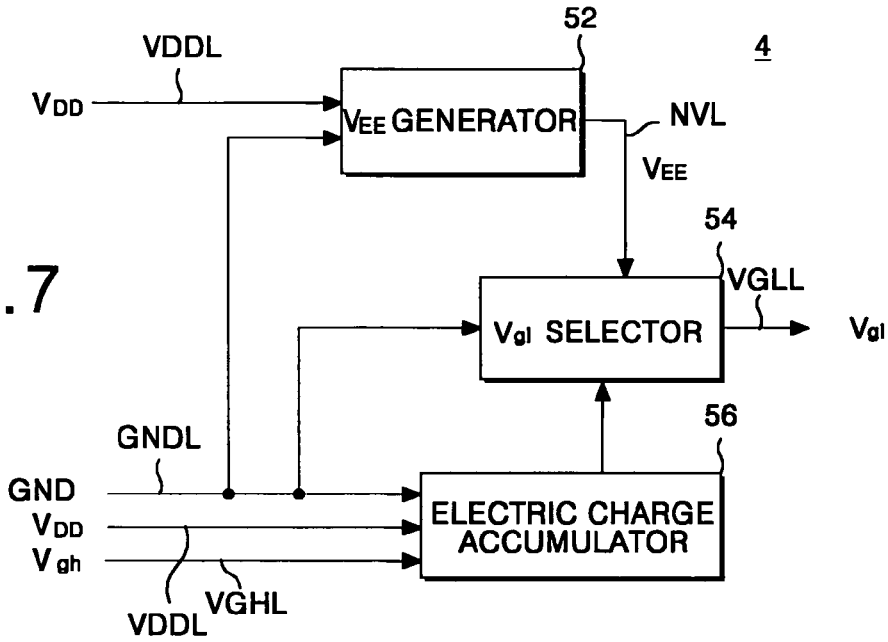
FIG. 7 is a detailed block diagram of the gate low voltage generator shown in FIG. 6.

FIG. 7 is a block diagram showing an embodiment of the gate low voltage generator 4 in FIG. 6. In FIG. 7, the gate low voltage generator 4, which is a form of a DC to DC converter, includes a negative voltage generator 52 for generating a negative polarity voltage $V_{EE}$ having a direct current shape or an alternating current shape, an electric charge accumulator 56 for accumulating an electric charge, and a gate low voltage selector 54 connected commonly to the negative voltage generator 52 and the electric charge accumulator 56 to supply the gate low voltage line VGLL with a gate low voltage Vg1 having a higher voltage than the ground level GND after turning off of the power supply transiently and having a lower voltage than the ground level GND during displaying image on the liquid crystal display panel.

The negative voltage generator 52 is connected between the power supply 2 and the gate low voltage selector 54 to invert the polarity of the supply voltage $V_{DD}$ having a positive polarity level inputted to itself through a supply voltage line VDDL, thus generating a negative polarity voltage $V_{EE}$ (e.g., −5V) on a negative voltage line NVL. Also, the negative voltage generator 52 may generate a negative polarity voltage $V_{EE}$ having an alternating current signal shape by inverting the polarity of the supply voltage $V_{DD}$ and controlling a level of the inverted supply voltage. Then, the negative polarity voltage $V_{EE}$ produced in this manner is supplied to the gate low voltage selector 54 through the negative voltage line NVL.

The electric charge accumulator 56 is connected to the gate high voltage generator 6 and/or the power supply 2 and, at the same time, to the gate low voltage selector 54, thereby charging an electric charge from the gate high voltage generator 6 applied thereto through a gate high voltage line VGHL when the supply voltage $V_{DD}$ has a positive polarity voltage. That is, when a power of the liquid crystal display panel is turned off (when a power source of the liquid crystal display panel is turned off to the gate low voltage selector 54), the electric charge accumulator 56 discharges electric charge to the gate driver 20 when the supply voltage $V_{DD}$ drops to the ground level GND. The gate low voltage selector 54 connected between the negative voltage generator 52 and the electric charge accumulator 56 raises the gate low voltage Vg1 as seen from FIG. 8 in such a manner that the gate low voltage Vg1 has a higher voltage level than the ground level GND with the aid of an electric charge applied from the electric charge accumulator 56 when the supply voltage $V_{DD}$ drops to the ground level GND. The negative voltage generator 52, gate low voltage selector 54 and electric charge accumulator 56 receive a ground voltage GND from the power supply 2 through a ground voltage line GNDL. At this time, the gate low voltage generator 4, gate high voltage generator 6, common voltage generator 8, gate driver 20 and data driver 30 are controlled by means of a controller (not shown) formed on one PCB (Printed Circuit Board) together.

Figure 8:
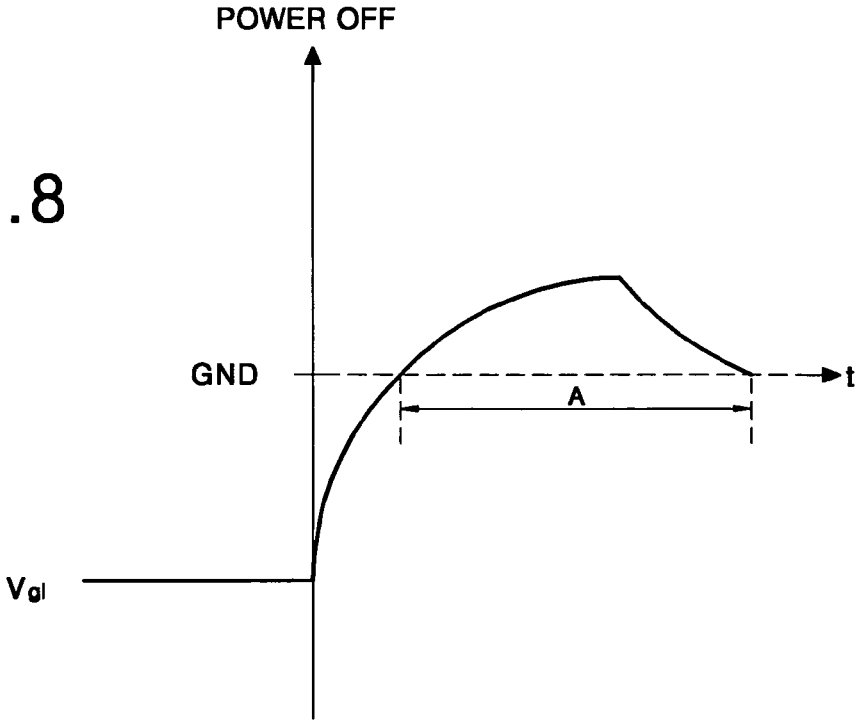
FIG. 8 is a waveform diagram showing a variation in a gate low voltage output from the gate low voltage selector in FIG. 7 during power-off.

As shown in FIG. 8, when a power source of the liquid crystal display panel is turned off, the gate low voltage Vg1 rises from a negative polarity level to a voltage higher than the ground level GND and thereafter drops to the ground level GND. Accordingly, during a time interval A the gate low voltage Vg1 having a higher voltage level than the ground level GND is applied to the gate of the TFT MN, thus opening the channel of the TFT MN. As a result, electric charges stored in the liquid crystal cell 12 and the support capacitor 14 are discharged into the source lines 13 over the opened channel of the TFT MN. In other words, if the voltage on the gate of TFT MN is equal to the voltages on the drain and source or small than the voltages on the drain and source of TFT MN, an OFF current signal flows along the channel of the TFT MN. Also, a current signal having an intermediate value between an ON current signal and the OFF current signal is developed on the channel of the TFT MN when the voltage on the gate of TFT MN is larger than any one of the voltages on the drain and source of the TFT MN. Consequently, the electric charges charged in the pixel can be discharged rapidly. The pixel can obtain the high discharging effect when the gate low voltage has a voltage higher than the threshold voltage of the TFT MN. But the pixel provides with a sufficiently discharging effect even when the gate low voltage Vg1 arrives at a voltage between the ground level and the threshold voltage level of the TFT MN.

Figure 9:
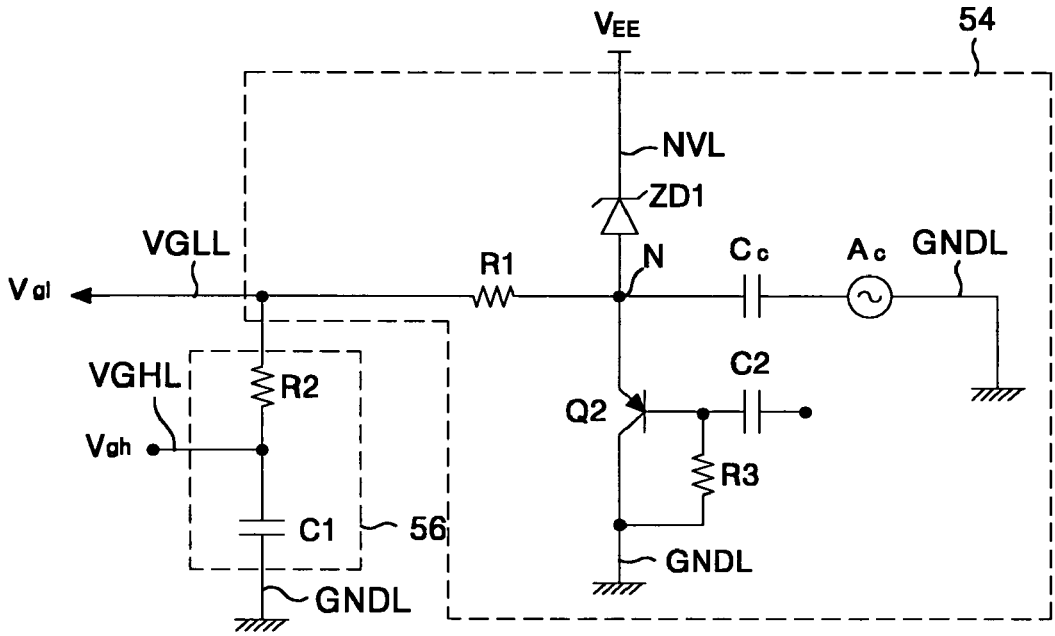
FIG. 9 is a circuit diagram of a first embodiment of the gate low voltage selector and the electric charge accumulator shown in FIG. 7.

FIG. 9 is a detailed circuit diagram of a first embodiment of the gate low voltage selector 54 and the electric charge accumulator 56 shown in FIG. 7. In FIG. 9, the gate low voltage selector 54 includes a zener diode ZD 1 for lowering a negative polarity voltage $V_{EE}$ from the negative voltage generator 52 to its breakdown voltage and supplying the lowered voltage to the gate low voltage line VGLL, a transistor Q2 for converging an output voltage of the zener diode ZD1 into the ground level GND when a power source of the liquid crystal display panel is turned off, and a first resistor R1 connected between the connection node N of the emitter of the transistor Q2 and the zener diode ZD1 and the gate low voltage line VGLL. If the gate high voltage Vgh is a direct current signal during displaying of image, the zener diode ZD can be eliminated and the proper voltage signal can be applied to the connection node N as the negative polarity voltage $V_{EE}$. The electric charge accumulator 56 includes a capacitor C1 for charging an electric charge caused by the gate high voltage Vgh on the gate high voltage line VGHL, and a second resistor R2 connected between the capacitor C1 and the gate low voltage line VGLL to prevent an electric charge from being leaked into the gate low voltage line VGLL when the gate high voltage Vgh is charged into the capacitor C1. The gate low voltage line VGLL is connected to the gate driver shown in FIG. 6 to apply the gate low voltage Vg1 to the gate driver 20. The first resistor R1 prevents the electric charge charged in the capacitor C1 from being bypassed, via the collector and the emitter of the transistor Q2, into the ground level GND and, at the same time, limits a current amount of a voltage signal applied from the connection node N to the gate low voltage line VGLL. The first resistor R1 has a resistance value of above 0. If the gate high voltage Vgh applied to the electric charge accumulator 56 is enlarged during operation of the panel, the second resistor R2 prevents the gate low voltage line VGLL from the gate high voltage. Whereas, in the case of eliminating of second resister R2, the TFT MN can be turned-off by means of the gate high voltage Vgh having a higher voltage level and the discharging of the capacitor C1 is affected from the gate high voltage Vgh having the higher voltage level.

Also, the gate low voltage selector 54 has a capacitor C2 connected between the supply voltage line VDDL and the base of the transistor Q2, and a third resistor R3 connected between the base and collector of the transistor Q2. The transistor Q2 is a PNP-type transistor which receives a supply voltage $V_{DD}$ having a positive level (e.g., 5V or 3.3V) from the supply voltage line VDDL at its base thereof through the capacitor C2 when a power source of the liquid crystal display panel is turned on. At this time, since almost an infinite value of resistance exists between the emitter and the collector of the transistor Q2, the voltage signal on the connection node N between the zener diode ZD and the transistor Q2 is not bypassed into the ground voltage GND, but it is supplied to the gate low voltage line VGLL. Meanwhile, the capacitor C2 charges the supply voltage $V_{DD}$ from the supply voltage line VDDL. At this time, a negative polarity voltage $V_{EE}$ dropped by means of the zener diode ZD1 is output, via the node N and the first resistor R1, to the gate low voltage line VGLL. Further, the capacitor C1 is charged with the gate high voltage Vgh on the gate high voltage line VGHL, and the second resistor R2 suppresses an electric charge charged in the capacitor C1.

Otherwise, when a power source of the liquid crystal display panel is turned off, the supply voltage $V_{DD}$ on the supply voltage line VDDL and the negative polarity voltage $V_{EE}$ on the negative voltage line NVL are converged to the ground level GND, and an electric charge charged in the capacitor C1 is discharged, via the second resistor R2, the gate low voltage line VGHL and the first resistor R1, into the node N. At the same time, the capacitor C1 applies a negative polarity voltage—$V_{DD}$ to the base of the transistor Q2 by the charged electric charges thereof. Then, the transistor Q2 is turned on to connect the node N to the ground voltage line GNDL, thereby increasing a voltage at the node N into the ground level GND rapidly. Accordingly, a voltage on the gate low voltage line VGLL also is raised into a level higher than the ground level as seen from FIG. 8. If the capacitor C1 is sufficiently large the gate low voltage Vg1 can be raised into a level higher than the threshold voltage of the TFT MN based on the ground level GND.

Then, an electric charge amount discharged from the capacitor C1 is gradually reduced, and a voltage on the gate low voltage line VGLL maintains the ground level GND upon complete discharging. As a result, a gate low voltage Vg1 as shown in FIG. 8 emerges at the gate low voltage line VGLL. A voltage on the data line 13 drops to the ground level GND during a time interval A at which the gate low voltage Vg1 in FIG. 8 rises to higher than the ground level GND and thereafter drops to the ground level GND.

During the time interval A, a gate low voltage Vg1 higher than the ground level GND is applied to the gate of the TFT MN, thereby opening a channel of the TFT MN. Accordingly, electric charges stored in the liquid crystal cell 12 and the support capacitor 14 are discharged into the source lines 13 over the opened channel of the TFT MN. The time interval A, at which the gate low voltage Vg1 maintains a voltage level higher than the ground level GND, is determined by a time constant value depending on the second resistor R2 and the capacitor C1 and a parasitic resistor (not shown) in the path of the gate high voltage Vgh (i.e., in the gate high voltage line VGHL). The gate high voltage Vgh is available if higher than the ground level GND, but it has preferably the highest level voltage in the supply voltages used in the liquid crystal display panel. In other words, the capacitor C1 has been charged by means of the gate high voltage Vgh in the present embodiment, but it may be charged by means of any supply voltage higher than the ground level GND.

Moreover, the gate low voltage selector 54 may include a serial connection of a coupling capacitor Cc and a alternating current voltage source AC arranged between the node N and the ground voltage line GNDL. The alternating current voltage source supplies an alternating current voltage to the node N when a power source is turned on, thereby changing the gate low voltage Vg1 on the gate low voltage line VGLL in a constant period. The coupling capacitor Cc cuts off a direct current voltage component that can be applied from the alternating current voltage source AC to the node N. Such coupling capacitor Cc and alternating current voltage source AC are used when the liquid crystal display panel is driven in the line inversion system.

Figure 10:
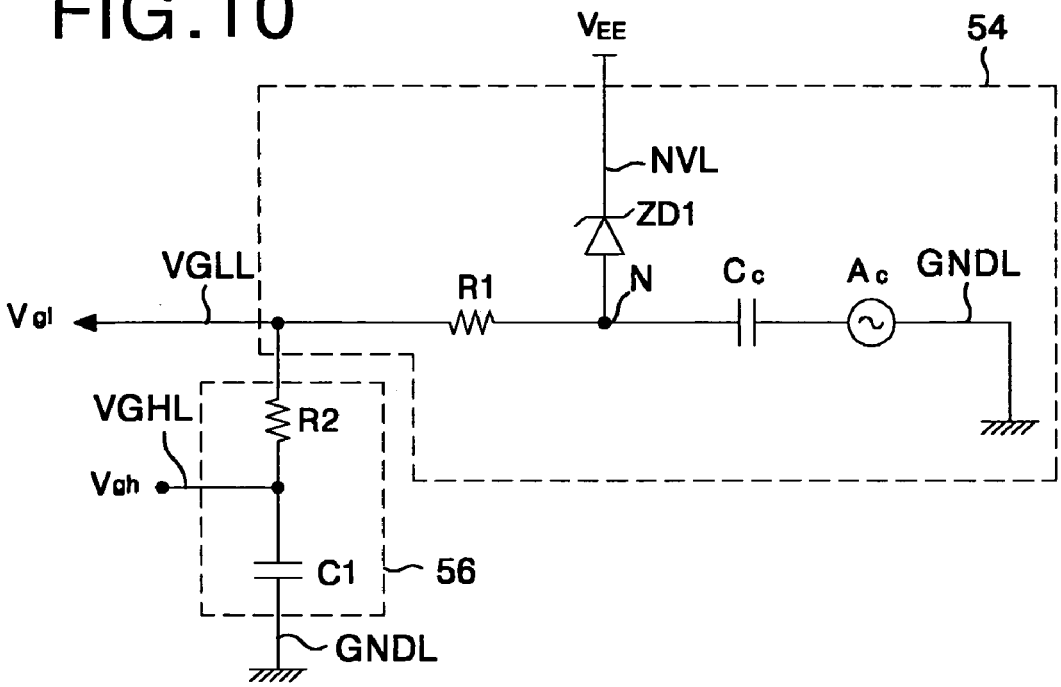
FIG. 10 is a detailed circuit diagram of a second embodiment of the gate low voltage selector and the electric charge accumulator shown in FIG. 7.

FIG. 10 is a detailed circuit diagram of a second embodiment of the gate low voltage selector 54 and the electric charge accumulator 56 shown in FIG. 7. In FIG. 10, the gate low voltage selector 54 includes a zener diode ZD1 for lowering a negative polarity voltage $V_{EE}$ from the negative voltage generator 52 through the negative voltage line NVL to its breakdown voltage and supplying the lowered voltage to the gate low voltage lines VGLL, and a first resistor R1 connected between the connection node N coupled to the zener diode ZD1 and the gate low voltage line VGLL. If the gate high voltage Vgh is a direct current signal during displaying of image, the zener diode ZD can be eliminated and the proper voltage signal can be applied to the connection node N as the negative polarity voltage $V_{EE}$. The electric charge accumulator 56 includes a capacitor C1 for charging an electric charge caused by the gate high voltage Vgh on the gate high voltage line VGHL, and a second resistor R2 connected between the capacitor C1 and the gate low voltage line VGLL to prevent an electric charge from being leaked into the gate low voltage line VGLL when the gate high voltage Vgh is charged into the capacitor C1. The gate low voltage line VGLL is connected to the gate driver shown in FIG. 6 to apply the gate low voltage Vg1 to the gate driver 20. The first resistor R1 prevents the electric charge charged in the capacitor C1 from being bypassed, toward the connection node N and, at the same time, limits a current amount of a voltage signal applied from the connection node N to the gate low voltage line VGLL. The first resistor R1 has a resistance value of above 0. If the gate high voltage Vgh applied to the electric charge accumulator 56 is enlarged during operation of the panel, the second resistor R2 prevents the gate low voltage line VGLL from the gate high voltage. Whereas, in the case of eliminating of second resister R2, the TFT MN can be turned-off by means of the gate high voltage Vgh having a higher voltage level and the discharging of the capacitor C1 is affected from the gate high voltage Vgh having the higher voltage level.

The capacitor C1 is charged with the gate high voltage Vgh from the gate high voltage line VGHL, and the second resistor R2 suppresses an electric charge charged in the capacitor C1. Otherwise, when a power source of the liquid crystal display panel is turned off, the negative polarity voltage $V_{EE}$ applied from the negative voltage line NVL to the zener diode ZD1 are converged to the ground level GND, and an electric charge charged in the capacitor C1 is discharged, via the second resistor R2, the gate low voltage line VGLL and the first resistor R1, into the node N. Accordingly, a voltage at the node N increases into the ground level GND rapidly. At this time, a voltage on the gate low voltage line VGLL also is raised into a level higher than the ground level as seen from FIG. 8. If the capacitor C1 is sufficiently large the gate low voltage Vg1 can be raised into a level higher than the threshold voltage of the TFT MN based on the ground level GND.

Then, an electric charge amount discharged from the capacitor C1 is gradually reduced, and a voltage on the gate low voltage line VGLL maintains the ground level GND upon complete discharging. As a result, a gate low voltage Vg1 as shown in FIG. 8 emerges at the gate low voltage line VGLL. A voltage on the data line 13 drops to the ground level GND during a time interval A at which the gate low voltage Vg1 in FIG. 8 rises to higher than the ground level GND and thereafter drops to the ground level GND.

During the time interval A, a gate low voltage Vg1 higher than the ground level GND is applied to the gate of the TFT MN, thereby opening a channel of the TFT MN. Accordingly, electric charges stored in the liquid crystal cell 12 and the support capacitor 14 are discharged into the source lines 13 over the opened channel of the TFT MN. The time interval A, at which the gate low voltage Vg1 maintains a voltage level higher than the ground level GND, is determined by a time constant value depending on the second resistor R2 and the capacitor C1 and a parasitic resistor (not shown) in the path of the gate high voltage Vgh, (i.e., in the gate high voltage line VGHL). The gate high voltage Vgh is available if higher than the ground level GND, but it has preferably the highest level voltage in the supply voltages used in the liquid crystal display panel. In other words, the capacitor C1 has been charged by means of the gate high voltage Vgh in the present embodiment, but it may be charged by means of any supply voltage higher than the ground level GND.

Moreover, the gate low voltage selector 54 may include a serial connection of a coupling capacitor Cc and an alternating current voltage source AC arranged between the node N and the ground voltage line GNDL. The alternating current voltage source supplies an alternating current voltage to the node N when a power source is turned on, thereby changing the gate low voltage Vg1 on the ground voltage line GNDL in a constant period. The coupling capacitor Cc cuts off a direct current voltage component that can be applied from the alternating current voltage source AC to the node N. Such coupling capacitor Cc and alternating current voltage source AC are used when the liquid crystal display panel is driven in the line inversion system.

As described above, the gate low voltage selector 54 of FIG. 10 provides with the effect same as the gate low voltage selector 54 of FIG. 9, without the capacitor C2, transistor Q2 and third resistor R3. Consequently, the gate low voltage selector 54 of FIG. 10 simplifies a circuit construction thereof.

Figure 11:
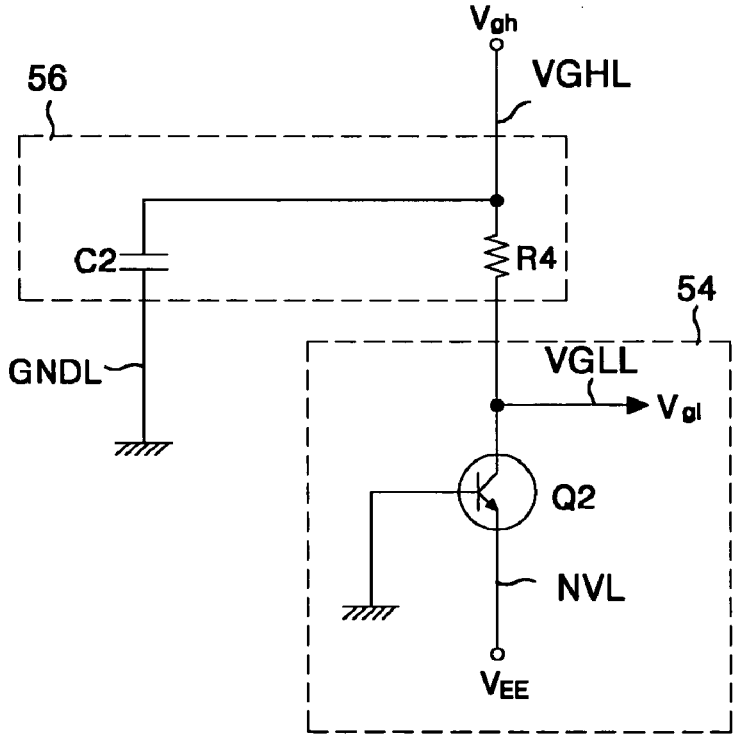
FIG. 11 is a detailed circuit diagram of a second embodiment of the gate low voltage selector and the electric charge accumulator shown in FIG. 7.

FIG. 11 is a detailed circuit diagram of a third embodiment of the gate low voltage selector 54 and the electric charge accumulator 56 shown in FIG. 7. In FIG. 10, the gate low voltage selector 54 includes a transistor Q3 for switching a negative polarity voltage $V_{EE}$ to be supplied from the negative voltage generator 52 in FIG. 7 to the gate low voltage line VGLL. The electric charge accumulator 56 includes a pull-up resistor R4 connected between the gate high voltage line VGHL and the gate low voltage line VGLL, and a capacitor C3 connected between the gate high voltage line VGHL and the ground voltage line GNDL. The transistor Q3 is a NPN—type transistor which has a base connected to the ground voltage line GNDL.

When a power source of the liquid crystal display panel is turned on, the transistor Q3 is turned on with the aid of a negative polarity voltage $V_{EE}$ supplied from the negative voltage generator 52 in FIG. 7 to the emitter thereof. It results from a voltage difference corresponding to the negative polarity voltage $V_{EE}$ being generated between the base and the emitter of the transistor Q3 by the negative polarity voltage $V_{EE}$. In other words, when a power source of the liquid crystal display panel is turned on, the transistor Q3 is turned on to define a current path between the emitter and the collector thereof. The negative polarity voltage $V_{EE}$ is applied to the gate low voltage line VGLL over the current path, thereby emerging a gate low voltage Vg1 having the negative polarity voltage $V_{EE}$. The pull-up resistor R4 prevents the gate high voltage Vgh applied from the gate high voltage generator 6 through the gate high voltage line VGHL from being supplied to the gate low voltage line VGLL. If the gate high voltage Vgh applied to the electric charge accumulator 56 is enlarged during operation of the panel, the pull-up resistor R4 prevents the gate low voltage line VGLL from the gate high voltage. Whereas, in the case of eliminating of pull-up resistor R4, the TFT MN can be turned-off by means of the gate high voltage Vgh having a higher voltage level and the discharging of the capacitor C3 is affected from the gate high voltage Vgh having the higher voltage level. Accordingly, the gate high voltage Vgh on the gate high voltage line VGHL is charged into the capacitor C3.

When a power source of the liquid crystal display panel is turned off, the gate high voltage Vgh on the gate high voltage line VGHL and the negative polarity voltage $V_{EE}$ on the negative voltage line NVL are converged to the ground level GND and thus a voltage difference between the emitter and the collector of the transistor Q3 is converged substantially to '0 V'. Accordingly, the current path between the emitter and the collector of the transistor Q3 is opened, and electric charges accumulated in the capacitor C3 are discharged, via the gate high voltage line VGHL and the pull-up resistor R4, into the gate low voltage line VGLL. As a result, the gate low voltage Vg1 on the gate low voltage line VGLL changes as seen from FIG. 8. The gate low voltage Vg1 in FIG. 8 increases to higher than the ground level GND and thereafter drops to the ground level GND, thereby maintaining a higher voltage level than the ground level GND during a certain time interval A. On the other hand, a voltage on the source line 13 is reduced to the ground level GND.

During the time interval A, a gate low voltage Vg1 higher than the ground level GND is applied to the gate of the TFT MN to open a channel of the TFT MN. Accordingly, electric charges stored in the liquid crystal cell 12 and the support capacitor 14 are discharged into the source lines 13 over the opened channel of the TFT MN. The time interval A, at which the gate low voltage Vg1 maintains a higher voltage level than the ground level GND, is determined by values of the pull-up resistor R4 and the capacitor C3 and a parasitic resistor (not shown) in the path of the gate high voltage Vgh (i.e., in the gate high voltage line VGHL). The pull-up resistor R4 must have a sufficient resistance value enough to prevent the gate high voltage Vgh from being leaked into the gate low voltage line VGLL when the gate high voltage Vgh is charged into the capacitor C3. For example, assuming the time constant is 4 sec, the pull-up resistor R4 and the capacitor C3 preferably have a resistance value of 20 K and a capacitance value of about 60 to 200 micro F, respectively.

According to the present invention, when a power source of the liquid crystal display panel is turned off, a voltage at the gate line 11 maintains a voltage level higher than the ground level GND (i.e., a voltage level capable of producing a channel at the TFT) during a predetermined time interval, thereby providing a channel in the TFT. Accordingly, electric charges charged in the pixels in the positive or negative polarity based on the ground level GND are rapidly discharged, via the drains and the sources of the TFTs, into the source lines 13. As a result, according to the present invention, a residual image disappears within a shorter time. For example, as proven from the experiment, it takes more than one minute until any residual images disappear completely in the case of the conventional liquid crystal display device, whereas it takes less than 10 seconds until any residual images disappear completely in the case of the liquid crystal display device according to the present invention.

In the present invention, other forms of gate low voltage generator 4 for outputting higher gate low voltage during power off may be used. For example, a circuit for generating a pulse upon power off may be used.

As described above, in the residual image eliminating apparatus and method for the liquid crystal display device according to the present invention, a voltage at the gate line maintains a voltage level capable of opening a channel of the TFT during a certain time interval when a power source of the liquid crystal display panel is turned off, thereby discharging electric charges charged in the liquid crystal cells into the source lines. Accordingly, any residual images disappear rapidly when a power source of the liquid crystal display panel is turned off. As a result, the residual image eliminating apparatus and method for the liquid crystal display device according to the present invention is capable of effectively eliminating any residual images.

Although the present invention has been explained by the embodiments shown in the drawing hereinbefore, it should be understood to the ordinary skilled person in the art that the invention is not limited to the embodiments, but rather than that various changes or modifications thereof are possible without departing from the spirit of the invention. Accordingly, the scope of the invention shall be determined only by the appended claims and their equivalents.

What is claimed is:

1. A residual image eliminating apparatus for a liquid crystal display device, comprising:

a plurality of gate lines and a plurality of data lines arranged in the liquid crystal display and crossing with respect to each other, wherein thin film transistors defining liquid crystal cells are connected to the plurality of gate lines and the data lines to switch image signals applied to the liquid crystal cells; and level shifting means for receiving a power supply voltage and a ground voltage to apply a gate-off voltage for turning off the thin film transistors to the gate lines upon power-on and to apply a higher voltage level than the ground voltage to the gate lines upon power-off, wherein the level shifting means includes:

a zener diode for applying a negative input voltage lowered by its breakdown voltage to each one of the gate lines;

a transistor connected between the each one of the gate lines and the ground voltage to switch a current path to bypass a voltage at the sate line to the ground voltage during power-off; and a capacitor connected between the ground voltage and a gate-on voltage for charging electric charge with the gate-on voltage until a time of power-off and for applying a voltage higher than the ground voltage to the each one of the gate lines upon power-off; wherein said gate-on voltage enables said thin film transistors.

2. The residual image eliminating apparatus of claim 1, wherein the gate-off voltage has a lower voltage level than a minimum value of the image signals.

3. The residual image eliminating apparatus of claim 1, wherein the gate-off voltage is a voltage applied to the gate lines when the liquid crystal display panel is in operation.

4. The residual image eliminating apparatus of claim 1, wherein the level shifting means includes:

means for charging electric charges upon power-on of the liquid crystal display panel; and voltage selecting means for allowing a voltage charged in the charging means to be applied to the gate lines upon power-off of the liquid crystal display panel.

5. The residual image eliminating apparatus of claim 1, wherein the level shifting means allows a voltage level at the gate line to be raised into a voltage level between the ground voltage and a threshold voltage of the thin film transistors during power-off.

6. The residual image eliminating apparatus of claim 1, wherein the level shifting means further includes:

a first resistor for preventing an electric charge charged in the capacitor from being leaked into the gate line when the input charge voltage is charged into the capacitor; and a second resistor for preventing a voltage at the gate line from being applied to the transistor during power-off.

7. The residual image eliminating apparatus of claim 1, wherein the level shifting means further includes:

an alternating current voltage source for supplying an alternating current voltage to the gate lines; and a coupling capacitor for eliminating a direct current component included in the alternating current voltage.

8. A residual image eliminating method for a liquid crystal display device including thin film transistors connected between gate lines and data lines to switch image signals applied to liquid crystal cells, the method comprising the steps of:

receiving a power supply voltage and a ground voltage to generate and to apply a gate-off voltage for turning off the thin film transistors to the gate lines upon power-on;

accumulating electric charges with a gate-on voltage during power-on by using a capacitor connected between a ground voltage and said gate-on voltage, said gate-on voltage enabling the thin film transistor;

boosting the gate-off voltage to a higher level voltage than the ground voltage; and applying said higher level voltage than the ground voltage to the gate lines upon power-off.

9. The residual image eliminating method of claim 8, wherein the step of applying said higher level voltage at the gate lines to higher than the ground voltage includes:

discharging the accumulated electric charges into the gate line during power-off.

10. A device for eliminating residual images on a liquid crystal display device having gate lines and data lines intersectingly arranged to form liquid crystal cells, each liquid crystal cell having a thin film transistor, the device comprising:

a gate low voltage selector having a transistor connected between a first voltage source and a second voltage source to generate a gate-off voltage at an output; and an electric charge accumulator having a capacitor coupled to the output of the gate low voltage selector and the second voltage source, the capacitor is connected between a gate-on voltage source and the second voltage source, wherein when the first voltage source is turned on, the capacitor is charged with the gate-on voltage source and when the first voltage source is turned off, the capacitor boosts the gate off voltage at the output to be higher than a threshold voltage of the thin film transistor; wherein the gate-on voltage enables the thin film transistor.

11. The device of claim 10, wherein the gate low voltage selector includes a diode connected between the first voltage source and the transistor, and the electric charge accumulator includes a resistor connected in series with the capacitor, wherein the values of the resistor and the capacitor define an RC time constant.

12. The device of claim 11, wherein the diode is a zener diode and the transistor is a PNP type transistor.

13. The device of claim 11, the gate low voltage selector further including an alternating current source coupled to the output through a coupling capacitor to filter out DC components of the alternating current source.

14. The device of claim 10, wherein the gate low voltage selector includes a resistor connected between the gate-on voltage source and the transistor, and the electric charge accumulator includes a resistor connected in series with the capacitor.

15. The device of claim 14, wherein the values of the resistor and the capacitor define an RC time constant.

16. The device of claim 15, wherein the capacitor is charged during a normal operation of the liquid crystal display device and discharged when the gate-on voltage source is turned off.

17. The device of claim 16, wherein the transistor is an NPN type transistor.

18. A liquid crystal display device having a device for eliminating residual images, comprising:

gate lines and data lines intersectingly arranged to form liquid crystal cells, each liquid crystal cell having a thin film transistor;

a gate driver connected to the gate lines to enable thin film transistors connected to the gate lines;

a gate high voltage generator that produces a gate-on voltage to enable thin film transistors;

a gate low voltage selector having a transistor connected between a first voltage source and a second voltage source to generate a gate-off voltage at an output; and an electric charge accumulator having a capacitor coupled to the output and the second voltage source, the capacitor connected between a gate-on voltage and the second voltage source wherein when the first voltage source is turned on, the capacitor is charged with the gate-on voltage source and when the first voltage source is turned off, the capacitor boosts the gate off voltage at the output to be higher than a threshold voltage of the thin film transistor; wherein said gate-off voltage and said gate-on voltage disables and enables the thin film transistor, respectively.

19. The liquid crystal display device of claim 18, wherein the gate low voltage selector includes a diode connected between the first voltage source and the transistor, and the electric charge accumulator includes a resistor connected in series with the capacitor, wherein the values of the resistor and the capacitor define an RC time constant.

20. The liquid crystal display device of claim 19, wherein the diode is a zener diode and the transistor is a PNP type transistor.

21. The liquid crystal display device of claim 19, the gate low voltage selector further including an alternating current source coupled to the output through a coupling capacitor to filter out DC components of the alternating current source.

22. The liquid crystal display device of claim 18, wherein the gate low voltage selector includes a resistor connected between the gate-on voltage and the transistor, and the electric charge accumulator includes a resistor connected in series with the capacitor.

23. The liquid crystal display device of claim 22, wherein the values of the resistor and the capacitor define an RC time constant.

24. The liquid crystal display device of claim 23, wherein the capacitor is charged during a normal operation of the liquid crystal display device and discharged when the gate-on voltage source is turned off.

25. The liquid crystal display device of claim 24, wherein the transistor is an NPN type transistor.

* * * * *